US009108288B2

(12) United States Patent
Queen et al.

(10) Patent No.: US 9,108,288 B2
(45) Date of Patent: Aug. 18, 2015

(54) METHODS OF REMOVING ELECTRICAL RUNOUT IN A MACHINE SHAFT SURFACE

(75) Inventors: Ryan Queen, Amelia, OH (US); Kristopher Miller, Loveland, OH (US); Michael Graman, Cincinnati, OH (US)

(73) Assignee: SIEMENS INUDSTRY, INC., Alpharetta, GA (US)

( * ) Notice: Subject to any disclaimer, the term of this patent is extended or adjusted under 35 U.S.C. 154(b) by 474 days.

(21) Appl. No.: 13/586,670

(22) Filed: Aug. 15, 2012

(65) Prior Publication Data

US 2014/0051337 A1 Feb. 20, 2014

(51) Int. Cl.

| | |
|---|---|
| ***B24B 1/00*** | (2006.01) |
| ***B24B 49/10*** | (2006.01) |
| ***B24D 15/00*** | (2006.01) |

(52) U.S. Cl.

CPC ..... *B24B 1/00* (2013.01); *B24B 49/105* (2013.01); *B24D 15/00* (2013.01); *Y10T 29/49718* (2015.01)

(58) Field of Classification Search

CPC ..... B24B 49/10; B24B 49/105; G01H 1/00
USPC ..... 451/49, 51
See application file for complete search history.

(56) References Cited

U.S. PATENT DOCUMENTS

| | | | | | |
|---|---|---|---|---|---|
| 3,724,137 | A * | 4/1973 | Hofelt et al. | 451/254 |
| 3,986,380 | A * | 10/1976 | Biggs | 72/76 |
| 4,134,303 | A * | 1/1979 | Davis | 73/660 |
| 4,135,244 | A * | 1/1979 | Davis | 702/56 |
| 4,460,869 | A * | 7/1984 | Buser et al. | 324/200 |
| 5,025,594 | A * | 6/1991 | Lambert et al. | 451/27 |
| 5,365,458 | A * | 11/1994 | Tamura et al. | 700/279 |
| 6,203,405 | B1 * | 3/2001 | Hansen | 451/38 |
| 6,741,074 | B2 * | 5/2004 | DeBlock et al. | 324/227 |
| 7,112,762 | B2 * | 9/2006 | Finley et al. | 219/201 |
| 7,635,828 | B2 * | 12/2009 | Finley et al. | 219/494 |
| 7,902,487 | B2 | 3/2011 | Mistry | |
| 7,947,931 | B2 | 5/2011 | Finley | |
| 2004/0133299 | A1 * | 7/2004 | Goransson | 700/176 |
| 2006/0288788 | A1 * | 12/2006 | Mistry et al. | 73/660 |
| 2007/0082580 | A1 * | 4/2007 | Simakov et al. | 451/5 |
| 2010/0024199 | A1 | 2/2010 | Finley | |
| 2011/0309828 | A1 | 12/2011 | Kikaganeshwala | |

* cited by examiner

*Primary Examiner* — Lee D Wilson
*Assistant Examiner* — Tyrone V Hall, Jr.

(57) ABSTRACT

A method of removing electrical runout from a measurement surface of a rotatable machine shaft is disclosed. The method includes providing a sensor adjacent to the measurement surface of the rotatable machine shaft, rotating the rotatable machine shaft, measuring a combined runout of the measurement surface, determining an angular location of one or more local valleys on the measurement surface, and re-working the measurement surface at the angular location of the one or more local valleys. Re-work may be by polishing at the one or more local valleys. Various alternative methods are disclosed, as are other aspects.

20 Claims, 5 Drawing Sheets

METHODS OF REMOVING ELECTRICAL RUNOUT IN A MACHINE SHAFT SURFACE

FIELD

The present invention relates generally to methods of determining and correcting electrical runout in rotatable machine shafts.

BACKGROUND

Within induction and other electrical motors, vibration of the motor shafts may be measured and monitored to identify conditions that may be indicative of impending machine failure or the need for machine maintenance. For example, vibration of the rotor shaft may be measured, and if the vibration level is found to be above a predetermined threshold level, the detection system may signal a warning or initiate a follow-up action. The threshold level may be a peak-to-peak measurement value. For example, it is commonplace to use one or more non-contacting, eddy current proximity sensors to monitor such vibration levels. The one or more eddy current sensors may be positioned proximate to a suitable location on the rotor shaft, such as at a bearing journal or on another surface portion of the rotatable rotor shaft. The peak-to-peak runout value may be displayed on a suitable display, such as an oscilloscope or other device.

Runout measured by the eddy current sensor is, in actuality, a combined measurement of mechanical runout and electrical runout (hereinafter "combined runout"). Mechanical runout is the deviation in the mechanical dimension about the rotor shaft at the measurement surface. In particular, mechanical runout is generally limited to relatively-close tolerances during she machine shaft machining process, e.g., during lathe turning and/or grinding operations. Certain contributors to mechanical runout, such as shaft diameter, shaft roundness (e.g., circularity), and surface finish are generally met after the initial machining process is completed. However, even though rotor shaft mechanical runout readings, e.g., via dial indicator, profilometer, etc. may be within acceptable tolerances, the electrical runout due to material anomalies, material permeability variations, material resistivity, and/or other factors may provide a combined runout measured via the eddy current proximity sensor that may be outside of a desired tolerance level. Such tolerance levels may be set by certain runout standards, such as API 541, $4^{th}$ edition. In such instances, prior methods have attempted to re-work the shaft surface in an attempt to further reduce the combined runout measured by the eddy current proximity sensor.

However, existing methods for re-work of shaft surfaces (e.g., measurement surfaces such as shaft journals) tend to be complicated and take a substantial amount of time. Moreover, in some instances they may change the surface finish (e.g., roughness) appreciably or otherwise affect shaft dimensions. Thus, improved shaft re-work methods that are both efficient and cost effective and do not appreciably affect shaft dimensions are sought.

SUMMARY

In a first embodiment, a method of removing runout from a measurement surface of a rotatable machine shaft is provided. The method includes providing a sensor adjacent to the measurement surface of the rotatable machine shaft, rotating the rotatable machine shaft, measuring a combined runout of the measurement surface, determining an angular location of one or more local valleys on the measurement surface, and reworking the measurement surface at the angular location of the one or more local valleys.

In another method aspect, a method of removing runout from a measurement surface of a rotatable machine shaft is provided. The method includes positioning an eddy current sensor adjacent to the measurement surface of the rotatable machine shaft, rotating the rotatable machine shaft at a rotational speed of less than 250 RPM, measuring a combined runout of the measurement surface with the eddy current sensor, determining an angular location of one or more local valleys in the combined runout measurement of the measurement surface, reworking by polishing the measurement surface at the angular location of the one or more local valleys for a test period, and re-measuring a combined runout of the measurement surface with the eddy current sensor.

In yet another method aspect, a method of removing runout from a measurement surface of a rotatable machine shaft is provided. The method includes providing a sensor adjacent to the measurement surface of the rotatable machine shaft, rotating the rotatable machine shaft, measuring a combined runout of the measurement surface with the sensor, determining an angular location of one or more local valleys in the combined runout measurement of the measurement surface, and reworking by polishing the measurement surface at the angular location of the one or more local valleys until a peak-to-peak combined runout of the measurement surface is within a predetermined tolerance.

Still other aspects, features, and advantages of the present invention may be readily apparent from the following detailed description by illustrating a number of example embodiments and implementations, including the best mode contemplated for carrying out the present invention. The present invention may also be capable of other and different embodiments, and its several details may be modified in various respects, all without departing from the scope of the present invention. Accordingly, the drawings and descriptions are to be regarded as illustrative in nature, and not as restrictive. The invention is to cover all modifications, equivalents, and alternatives falling within the scope of the invention.

DESCRIPTION

In view of the foregoing difficulties, an improved runout re-work method is provided. The method of removing runout (e.g., electrical runout) from a measurement surface of a rotatable machine shaft includes providing a sensor (e.g., an eddy current sensor) adjacent to the measurement surface of the rotatable machine shaft, slowly rotating the rotatable machine shaft (e.g., a slow roll), and measuring a combined runout of the measurement surface with the sensor. From the combined runout measurement, an angular location of one or more local valleys (provided about one or more local minima) on the measurement surface is determined. The measurement surface is then re-worked at the angular location of the one or more local valleys. The re-working may be by localized polishing, such as with crocus cloth, sandpaper, or a silicon carbide cloth. The crocus cloth or sandpaper may have a fine, very fine, or even finer grade of grit. In accordance with one aspect, the entire re-work of the measurement surface may be completed in less than about 35 minutes. Moreover, the re-work according to another aspect does not appreciably affect the dimensions or surface finish of the rotatable machine shaft a rotatable rotor shaft).

As will become apparent from the various embodiments described, the method advantageously allows rapid and precise correction of an electrical component, of combined runout of one or more measurement surfaces of a rotatable machine shaft.

These and other embodiments of the method of removing runout from a measurement surface of a rotatable machine shaft are described below with reference to FIGS. 1A-5. The drawings are not necessarily drawn to scale. Like numerals are used throughout to denote like elements.

Figure 1A:
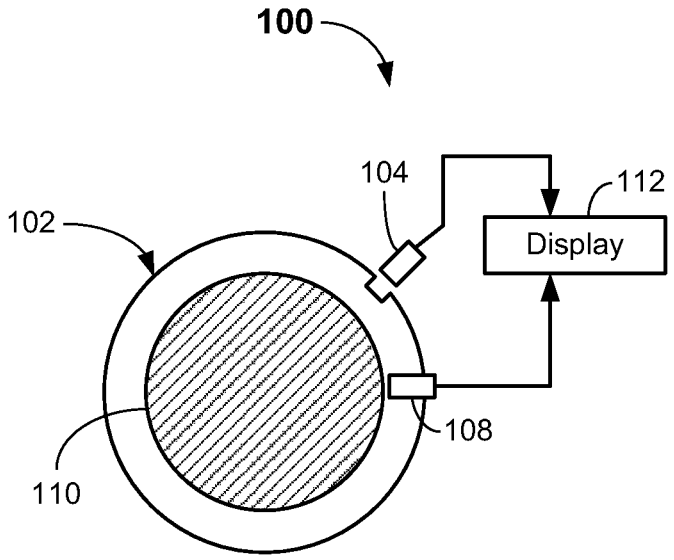
FIG. 1A illustrates a cross-sectioned end view of a portion of a runout measurement system adapted to measure combined runout in a shaft measurement surface according to embodiments.
Figure 1B:
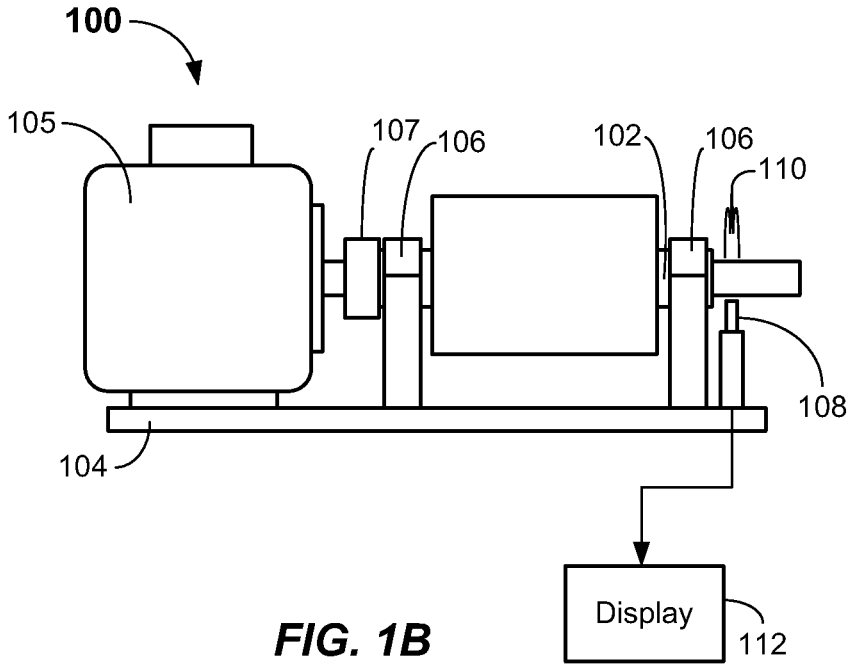
FIG. 1B illustrates a side view of a runout measurement system adapted to measure combined runout in a shaft measurement surface according to embodiments.

Referring now in specific detail to FIGS. 1A-1B, a runout measurement apparatus 100 is shown. The runout measurement apparatus 100 is adapted to receive a rotatable machine shaft 102 to be measured for combined runout and then re-worked if found to be outside of a predetermined acceptable combined runout threshold. The shaft 102 may be any type of shaft which will be monitored for vibration during use. For example, the shaft 102 may be a rotor shaft of an induction or other electrical motor.

The runout measurement apparatus 100 may include a support frame 104 which may be any rigid frame member having a drive motor 105 and one or more supports 106 mounted thereto. The drive motor may be of a suitable size to at least accomplish a slow roll of the rotatable machine shaft 102. The slow roll of the rotatable machine shaft 102 may be at a rotational speed of less than 250 RPM, for example. Other and slower speeds may be used. The rotatable machine shaft 102 may be mounted on the one or more supports 106 located along a length of the shaft 102. For example, such supports 106 may be located at the bearing journals of the shaft 102 and adapted for rotation relative to the supports. The supports 106 may comprise bearings or rollers that interface with bearing journals on the shaft 102. Journals as used herein are axial areas along the shaft 102 that are adapted to receive bearings, bushings, or the like. The journals allow smooth rotation of the shaft relative to the motor housing (not shown). The shaft 102 may be coupled for rotation to the drive motor 105, by any suitable coupling 107. The coupling 107 may be a chuck, flexible or elastic coupling, a metal bellows coupling, a universal type coupling, or the like. One or more sensors 108, such as one or more non-contact eddy current sensors, are mounted at a location that is in close proximity to a measurement surface 110 of the shaft 102. The measurement surface 110 may be any surface on the shaft 102 on which vibration is to be later measured and monitored when the shaft is in use. Such measurement surface 110 may be located anywhere along a length of the shaft 102, such as at, or adjacent to, a bearing journal. In the depicted embodiment, the measurement surface 110 is shown adjacent to a journal. If the sensor 108 is located at the journal location, then the sensor 108 may be mounted such that an exposed portion of the journal surface may be measured and may comprise the measurement surface 110.

Generally, the measurement surface 110 extends 360 degrees around the shaft 102 and may be between about 20 mm and 40 mm in width. However other widths may be provided. The measurement surface 110 may be manufactured to have tight mechanical dimensional tolerances. For example, the mechanical tolerances may include +/−0.03 mm on diameter, 0.2-0.8 micrometers of surface roughness, 0.005 mm of mechanical runout and residual magnetism of less than 2 Gauss total and less than 1 Gauss of variation (pk-pk). Also, in some embodiments, more than one measurement surface 110 may be provided. The one or more sensors 108 may be mounted relative to the shaft 102 so that a radial gap between the measuring surface of the sensor 108 and the measurement surface 110 is between about 0.3 mm and 2.5 mm, for example. Other gaps may be used depending upon the sensor 108 that is used. The one or more sensors 108 may be eddy current sensors available from Bently Nevada as Model 3300 XL Series. Other types of eddy current sensors may be used. The sensors 108 may be coupled electrically to conditioning electronics to amplify and/or condition the signal. Such conditioning electronics are also available from Bently Nevada as Model 3300 XL Series. A suitable trace of the combined runout may then be provided by a display 112. In order to provide a measurement of the angular orientation of the shaft 102, a rotation sensor 104 may be provided that senses angular position of the shaft 102 over time. The rotation sensor may trigger off from one or more geometrical features on the shaft 102. Optionally, the rotational orientation may be provided from a sensor of the motor 105.

The display 112 may be any suitable device that is adapted to display a trace of the combined runout as a function of angular rotational position of the shaft 102. For example, the display 112 may be provided by an oscilloscope, a computer, a printout, or the like.

For example, a display 112 may visually display, locate, or otherwise identify a location of one or more local minima and a valley surrounding each minima (referred to herein as a "local valley") in the combined runout trace. The one more local valleys are radial areas about the periphery of the measurement surface 110 of lowest dimension (e.g., concavities) in the trace.

Figure 2A:
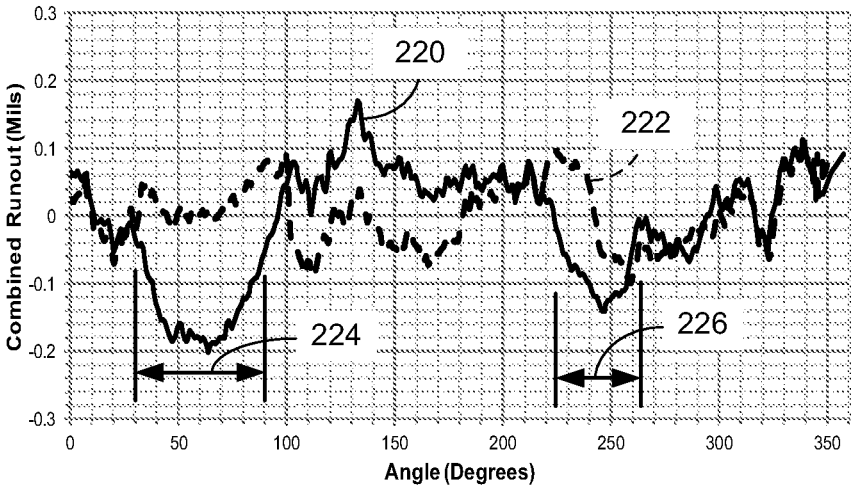
FIG. 2A illustrates slow roll traces of combined runout before and after implementing a re-work method at multiple local valleys according to embodiments.

FIG. 2A provides a first example of traces of the measurements of combined runout versus radial angle (between 0 degrees and 360 degrees) measured by the sensor 108 and illustrating the trace before re-work 220 (solid line) and a trace after re-work 222 (dotted line). First, a predefined peak-to-peak amplitude of the combined runout is determined to be above a predefined threshold value, indicating that re-work is needed to bring the combined runout within tolerance. In particular, in FIG. 2A, two locations about the radial periphery of the measurements surface 110 of the shaft 102 are deemed to be localized valleys 224, 226 by virtue of their values having the most negative combined runout amplitude. In each of these localized areas of the localized valleys 224, 226, re-work is performed. The re-work may be accomplished by polishing the measurement surface 110 at the location of the local valleys 224, 226 of the shaft 102. The polishing may be accomplished only within a radial arc segment of between about +/−30 degrees about the angular location of the minimas (i.e., the point, on the trace of lowest amplitude). If the localized valley is less pronounced, such as the localized valley 226, then a smaller arc segment (e.g., +/− about 20 degrees) may be re-worked by polishing a smaller arc segment. If the localized valley is larger, a slightly larger area may be re-worked. Other areas of the radial periphery remain untouched. As the re-working takes place at the local valleys 224, 226 the measured combined runout thereat is reduced, thereby lowering the peak-to peak amplitude of the combined runout. After the re-work, the combined runout may be brought within an acceptable tolerance as illustrated by the dotted trace 222 in FIG. 2A. It is believed that the re-work according to the method is addressing largely electrical runout of the measurement surface 110 as the physical dimensions of the shaft 102 remain substantially unchanged after the re-work.

Figure 2B:
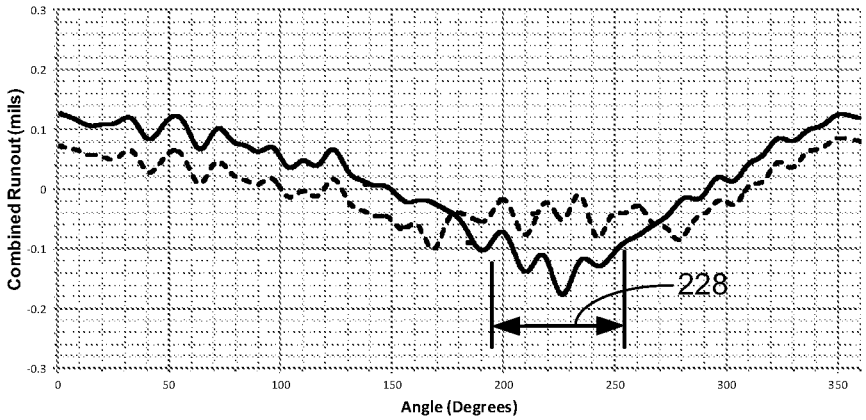
FIG. 2B illustrates slow roll traces of combined runout before and after implementing a re-work method at a single local valley according to embodiments.

Another embodiment of traces of a measurement surface 110 of a shaft is shown in FIG. 2B. In this embodiment, a few localized minimas are noted that are bunched closely together. In this case, the re-working may be carried out by polishing the local valley 228 about an angular region of +/− about 30 degrees about the angular location of the lowest minima. Other smaller arc segments adjacent to the minima may be subjected to re-working.

According to another aspect, the re-working of the measurement surface 110 at the location of the one or more local valleys (e.g., 224, 226, and 228) has no appreciable effect on a surface finish of the measurement surface 110. For example, within the tolerance of the measurement instrument, no appreciable change in surface finish may be noted, albeit the localized valleys may appear slightly shinier or duller than the surfaces chat are not reworked. Similarly, the re-working of the measurement surface 110 at the location of the one or more local valleys (e.g., 224, 226, and 228) has no appreciable effect on a diameter of the measurement surface, i.e., the diameter remains substantially unchanged. Additionally, the re-working of the measurement surface 110 at the location of the one or more local, valleys (e.g., 224, 226, and 228) has no appreciable effect on the residual magnetism of the shaft 102. Thus, it should be recognized that the present re-working method comprising polishing the localized valleys (e.g., 224, 226, and 228) does not change the overall dimensions of the shaft 102, such that tolerances and surface condition of the measurement surface 110 remain substantially unchanged. This is especially important when the measurement surface is at a bearing journal which may be subjected to fairly stringent mechanical tolerance limitations on diameter and surface finish ensuring smooth rotation of the shaft and/or ease of assembly of bearings thereon.

As discussed above, the re-working comprises polishing the measurement surface 110 at the location of the one or more local valleys (e.g., 224, 226, and 228). The re-working of the measurement surface 110 is generally so efficient, that the re-working of a shaft 102 is completed in less than about 35 minutes, whereas some previous heating re-work processes may have taken 10 hours or more to complete. In particular, in one embodiment, the re-working may take place by polishing of the measurement surface 110 by using a silicon carbide cloth. Any suitable silicon carbide cloth may be used such as SCOTCH-BRITE available from 3M. SCOTCH-BRITE Ultra Fine Hand Pad 7448 has been found to be effective. In particular, polishing of the measurement surface 110 may be accomplished using a fine grade of silicon carbide cloth. Optionally, the polishing of the measurement surface 110 may be accomplished using a sand paper (e.g., a crocus cloth). For example, the polishing of the measurement surface 110 may be accomplished using a cloth, having a fine grit of aluminum oxide thereon. A cloth or paper (sandpaper or crocus cloth) having a grit size of finer than 200, or even finer than 220, or even finer than 280, or even finer than 320, or even finer than 400 may be used.

Figure 3A:
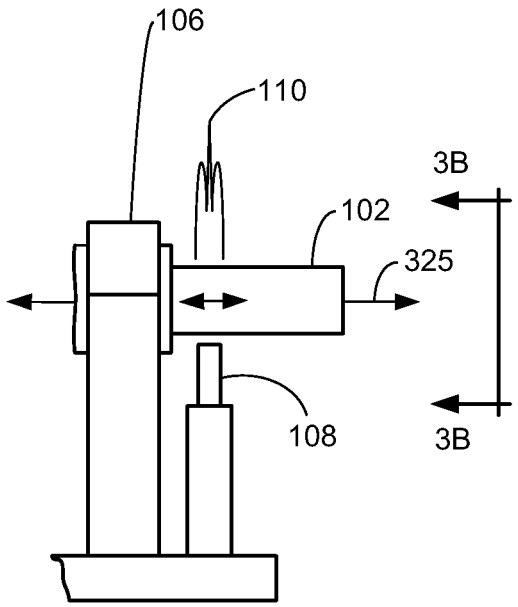
FIG. 3A illustrates a partial side view of a runout measurement system according to embodiments.
Figure 3B:
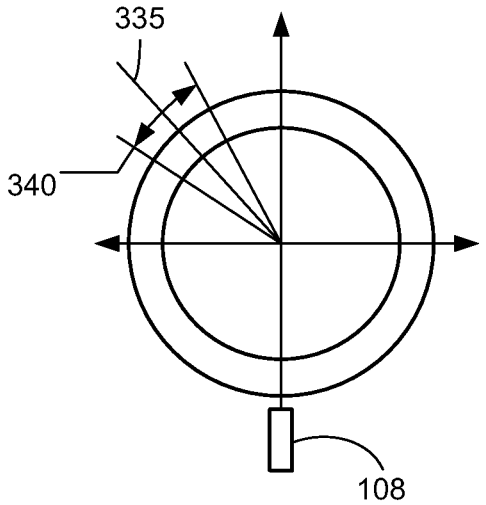
FIG. 3B illustrates an end view of a rotor shaft system illustrating an area of re-work located about a local minima according to embodiments.
Figure 4:
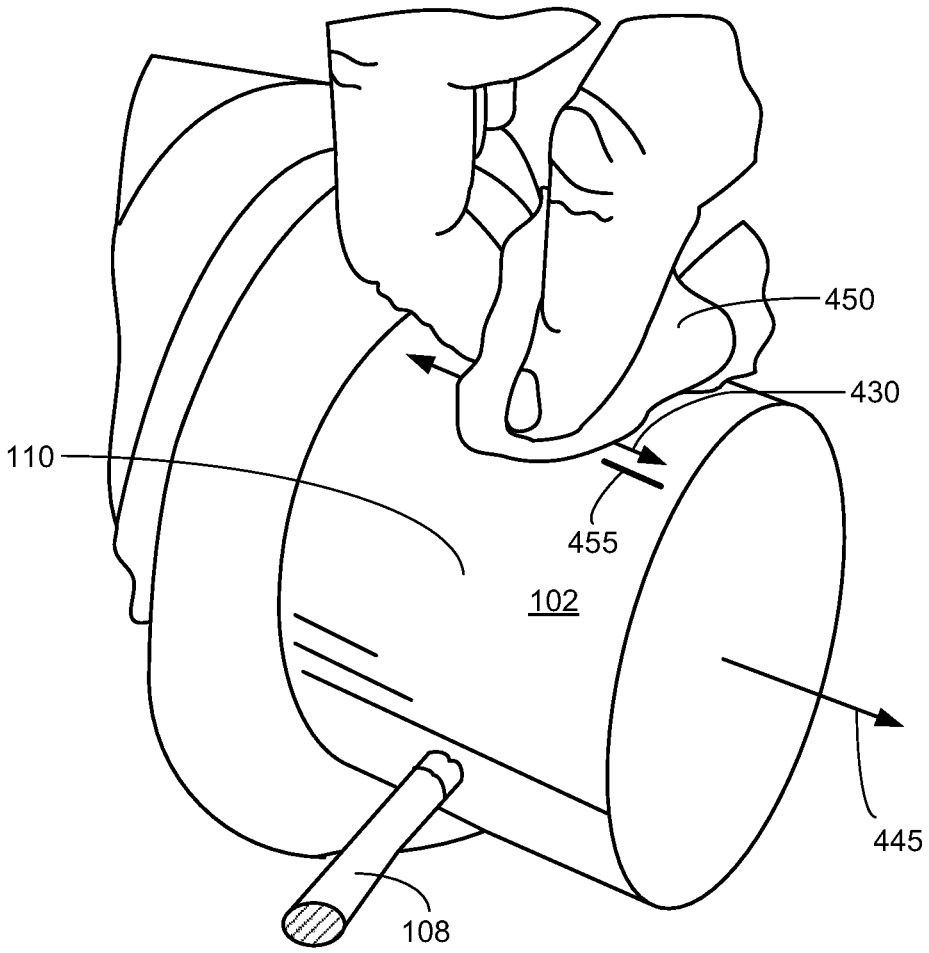
FIG. 4 illustrates implementing a re-work method at a single local valley according to embodiments.

As shown in FIGS. 3A-3B, the re-work comprises polishing the measurement surface 110 of the shaft 102 at a location that is axially aligned with where the sensor 108 will measure the combined runout. As shown in FIG. 31, once an angular location of a minima 335 on the measurement surface 110 is determined, the re-work can commence at the location of the local, valley 340 over the arc segment shown (e.g., +/− about 30 Degrees or less). As shown in FIG. 4, the re-work may take place in a direction that is generally parallel to an axial axis 445 of the rotatable machine shaft 102, such as along the direction of arrow 430. Polishing may be performed by polishing by hand by following a back and forth motion with a suitable polishing component 450 (e.g., a silicon carbide cloth). The polishing of the measurement surface at the angular location of the one or more local valleys may continue, with or without re-checking, until a peak-to-peak combined runout of the measurement surface 110 is within a desired predetermined tolerance. Of course, the reworking by polishing the measurement surface 110 at the angular location of the one or more local valleys may commence for a test period (e.g., 10-35 seconds), and then the combined runout of the measurement surface 110 may be re-measuring with the sensor 108 (e.g., non-contact eddy current sensor). If the measured combined run-out is still not within the predetermined tolerance, then the measurement surface 110 may again be re-worked by polishing the measurement surface 110 at the angular location of the one or more local valleys for another period of time (e.g., which may be longer than the to period).

In one or more embodiments, the polishing of the measurement surface 110 may take place for a test period of between about 10 seconds to about 35 seconds, followed by re-measuring a combined runout of the measurement surface 110 of the shaft 102 with the sensor 108. As part of the re-work method, an angular location of one or more local valleys on the measurement surface 110 may be marked locally, such as by marking a line 455. The line 155 may designate the location of a local minima of the slow roll trace, and may be marked with a permanent marker, for example, adjacent to or on the measurement surface 110.

Figure 5:
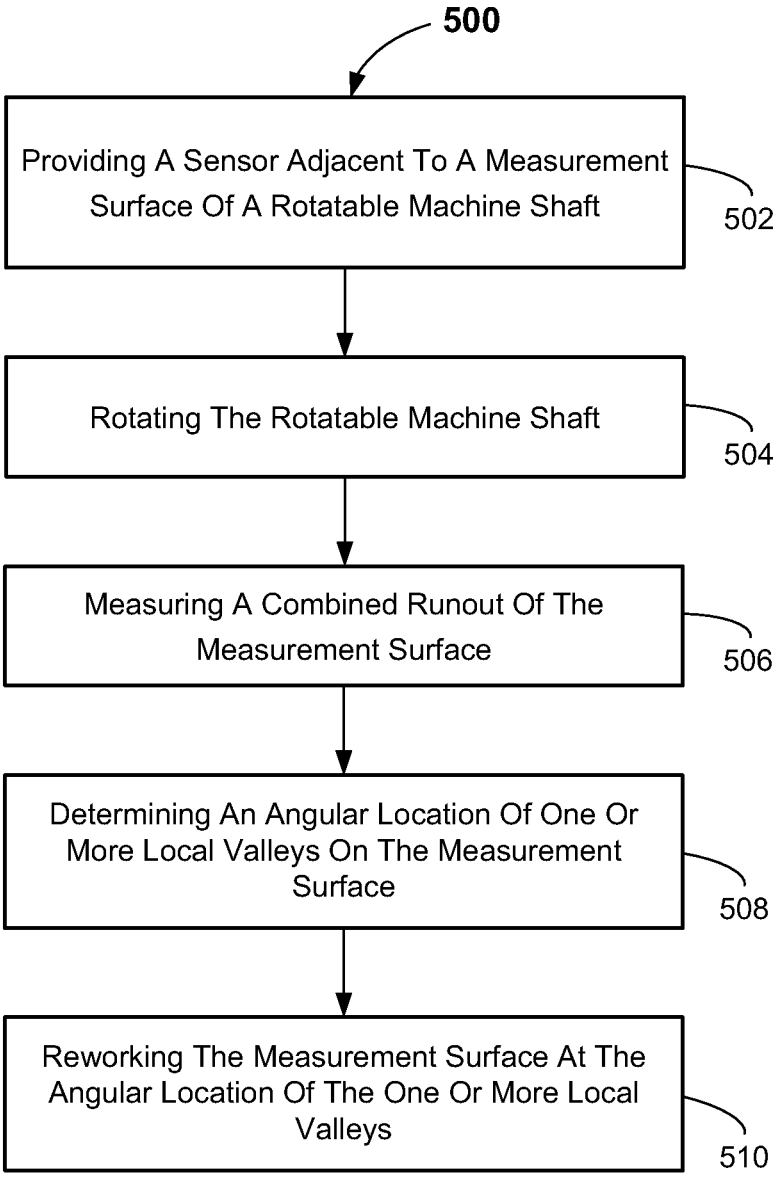
FIG. 5 is a flowchart illustrating a method of removing runout from a rotatable machine shaft according to embodiments.

Now referring to FIG. 5, a method 500 of removing runout from a measurement surface (e.g., measurement surface 110) of a rotatable machine shaft (e.g., rotatable machine shaft 102), comprising providing a sensor (e.g., sensor 108) adjacent to the measurement surface of the rotatable machine shaft in 502, rotating the rotatable machine shaft in 504, measuring a combined runout of the measurement surface in 506, determining an angular location of one or more local valleys on the measurement surface in 508, and re-working the measurement surface at the angular location of the one or more local valleys in 510. As discussed above, the re-working may be by polishing the one or more local valleys with an abrasive material such as crocus cloth, sandpaper, silicon carbide cloth, or the like.

While the invention is susceptible to various modifications and alternative forms, specific embodiments and methods thereof have been shown by way of example in the drawings and are described in detail herein, it should be understood, however, that it is not intended to limit the invention to the particular methods disclosed, but, to the contrary, the intention is to cover all modifications, equivalents and alternatives falling within the scope of the invention.

What is claimed is:

1. A method of removing runout from a measurement surface of a rotatable machine shaft, comprising:

providing a sensor adjacent to the measurement surface of the rotatable machine shaft;

rotating the rotatable machine shaft;

measuring a combined runout of the measurement surface;

determining an angular location of one or more local valleys on the measurement surface; and re-working the measurement surface at the angular location of the one or more local valleys, wherein the re-working comprises polishing the measurement surface at the location of the one or more local valleys, and wherein the polishing of the measurement surface is accomplished using a silicon carbide cloth.

2. The method of claim 1, wherein the re-working of the measurement surface at the location of the one or more local valleys has no appreciable effect on a surface finish of the measurement surface.

3. The method of claim 1, wherein the re-working of the measurement surface at the location of the one or more local valleys has no appreciable effect on a diameter of the measurement.

4. The method of claim 1, wherein the re-working of the measurement surface at the location of the one or more local valleys has no appreciable effect on the residual magnetism of the shaft.

5. The method of claim 1, wherein the re-working of the measurement surface is completed in less than 35 minutes.

6. The method of claim 1, wherein the polishing of the measurement surface is accomplished using a fine grade of silicon carbide cloth.

7. The method of claim 1, wherein the polishing of the measurement surface is accomplished on an area of +/− about 30 degrees around a location of a local minima.

8. The method of claim 1, wherein the polishing of the measurement surface is accomplished for a test period of between about 10 seconds and about 35 seconds followed by re-measuring a combined runout of the measurement surface.

9. The method of claim 1, wherein the re-working comprises polishing the measurement surface at the location of the one or more local valleys in a direction that is generally parallel to an axial axis of the rotatable machine shaft.

10. The method of claim 1, comprising marking an angular location of one or more local valleys adjacent to or on the measurement surface.

11. The method of claim 1, wherein the measuring of the combined runout of the measurement surface is accomplished using a non-contact eddy current sensor.

12. The method of claim 1, wherein the re-working comprises polishing the measurement surface at the location of two or more local valleys.

13. The method of claim 1, wherein the rework comprises polishing the measurement surface at the angular location of the one or more local valleys until a peak-to-peak combined runout of the measurement surface is within a predetermined tolerance.

14. A method of removing runout from a measurement surface of a rotatable machine shaft, comprising:

providing a sensor adjacent to the measurement surface of the rotatable machine shaft;

rotating the rotatable machine shaft;

measuring a combined runout of the measurement surface;

determining an angular location of one or more local valleys on the measurement surface; and re-working the measurement surface at the angular location of the one or more local valleys, wherein the re-working comprises polishing the measurement surface at the location of the one or more local valleys, and wherein the polishing of the measurement surface is accomplished using a crocus cloth.

15. The method of claim 14, wherein the re-working of the measurement surface is completed in less than 35 minutes.

16. The method of claim 14, wherein the polishing of the measurement surface is accomplished on an area of +/− about 30 degrees around a location of a local minima.

17. The method of claim 14, wherein the polishing of the measurement surface is accomplished for a test period of between about 10 seconds and about 35 seconds followed by re-measuring a combined runout of the measurement surface.

18. The method of claim 14, comprising marking an angular location of one or more local valleys adjacent to or on the measurement surface.

19. The method of claim 14, wherein the measuring of the combined runout of the measurement surface is accomplished using a non-contact eddy current sensor.

20. The method of claim 14, wherein the re-working comprises polishing the measurement surface at the angular location of the one or more local valleys until a peak-to-peak combined runout of the measurement surface is within a predetermined tolerance.

* * * * *